United States Patent [19]

Phelps

[11] 4,248,476

[45] Feb. 3, 1981

[54] CONVERTIBLE SEAT ASSEMBLY

[76] Inventor: Melvin B. Phelps, 700 SE. 32nd Ct., Ft. Lauderdale, Fla. 33316

[21] Appl. No.: 968,079

[22] Filed: Dec. 11, 1978

[51] Int. Cl.[3] ..... A47C 13/00

[52] U.S. Cl. ..... 297/118; 297/94; 297/192; 297/238

[58] Field of Search ..... 297/63, 94, 192, 118, 297/124, 238, 112, 118, 244; 9/7

[56] References Cited

U.S. PATENT DOCUMENTS

| | | | |
|---|---|---|---|
| 2,383,178 | 8/1945 | Edwards | 297/94 X |
| 2,481,943 | 9/1949 | Murphy et al. | 297/238 |
| 3,230,006 | 1/1966 | Sokolis | 297/193 |
| 3,379,471 | 4/1968 | Dalziel | 297/63 X |
| 3,884,522 | 5/1975 | Arima | 297/63 |

FOREIGN PATENT DOCUMENTS

| | | | |
|---|---|---|---|
| 2454573 | 5/1975 | Fed. Rep. of Germany | 297/244 |
| 2658097 | 7/1978 | Fed. Rep. of Germany | 297/244 |

*Primary Examiner*—James T. McCall

[57] ABSTRACT

A seat assembly device having a lower drawer storage compartment and being convertible into two back-to-back seats. The seat is comprised of a lower box-shaped base member having a sliding drawer storage area therein; the base member having a horizontal cushioned top and a cushioned back member extending vertically therefrom. The cushioned back member has a cushioned front and back face with the back face connected to the front face by a hinge member along the top edge of each face member. When not in use, the second seat member and its support means are folded behind said back face member and are secured to the base member along a rod extending along the top back edge of the base. In order to use the second seat, the back face is swung up along its hinge so that the second seat member can be lowered to a horizontal position and its support member swung out to a downward vertical position along the front edge of the second seat member. There is access to the storage drawer when one or both seats are in use; and the device only occupies the floor space under the base member when only one seat is in use.

5 Claims, 7 Drawing Figures

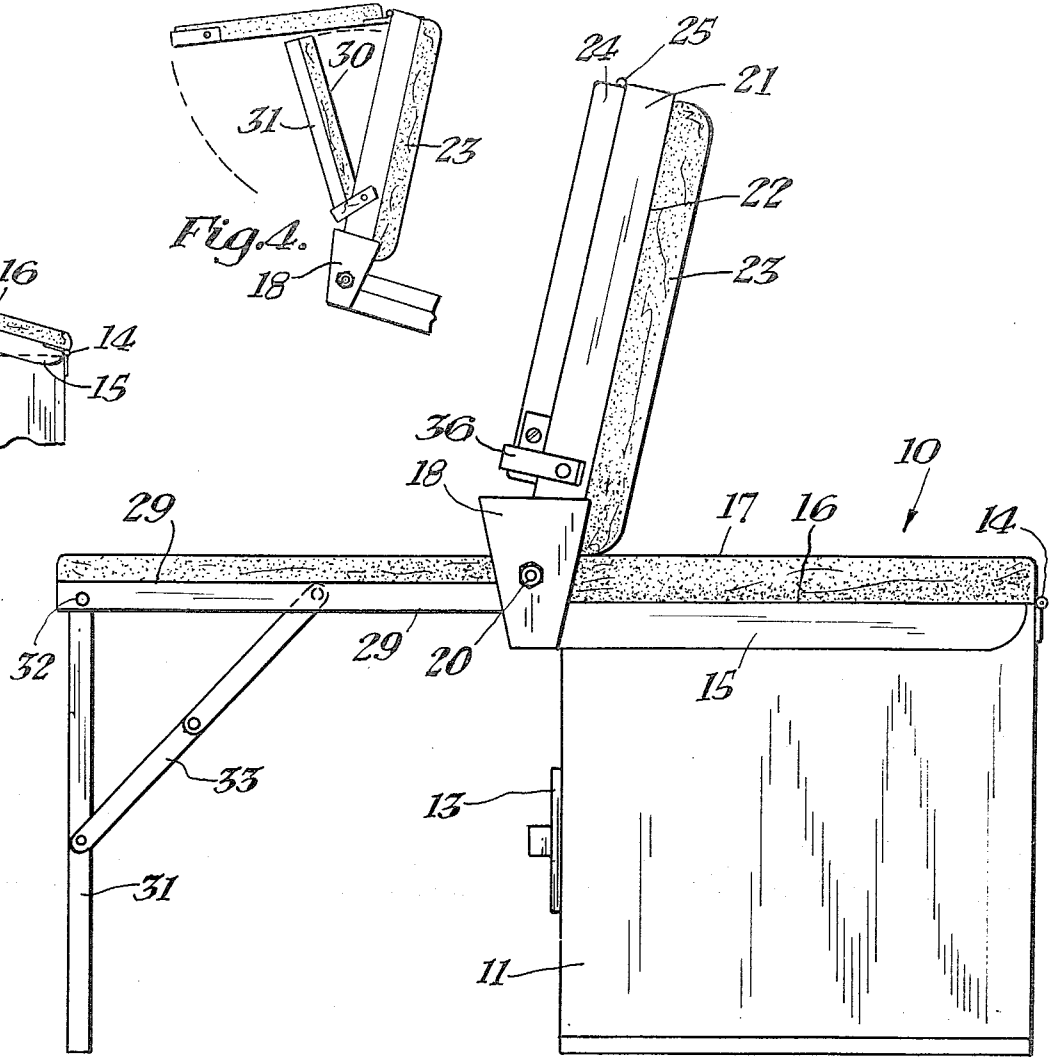
Fig. 1.
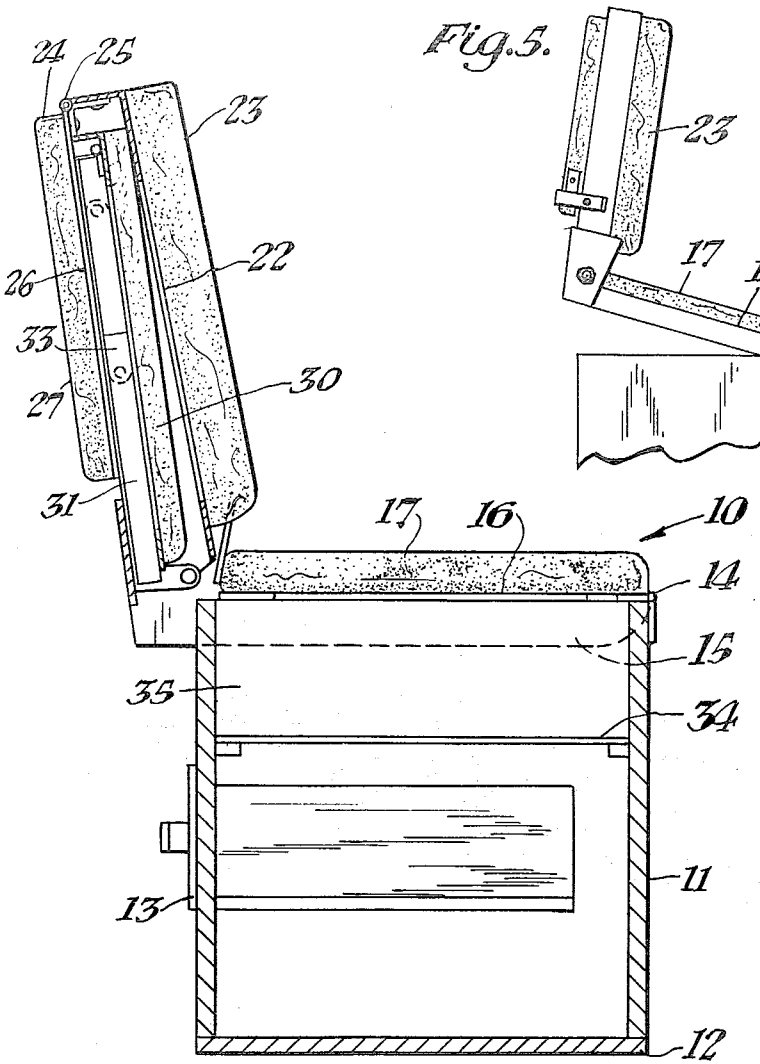
Fig. 2.
Fig. 4.
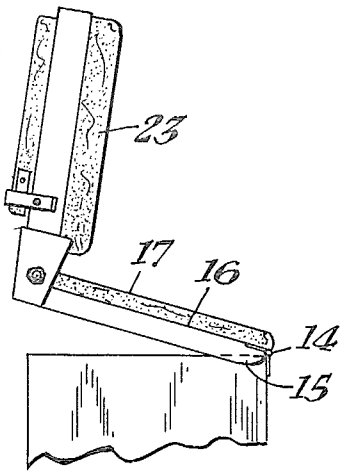
Fig. 5.

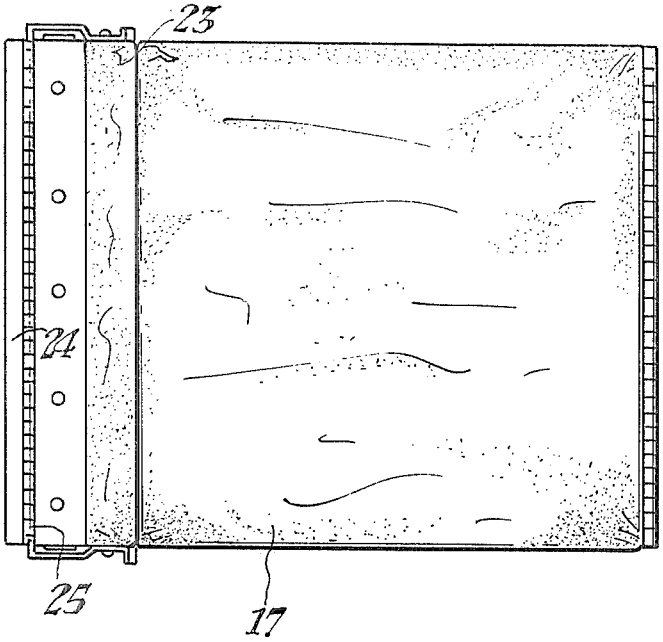
Fig. 6.
Fig. 7.
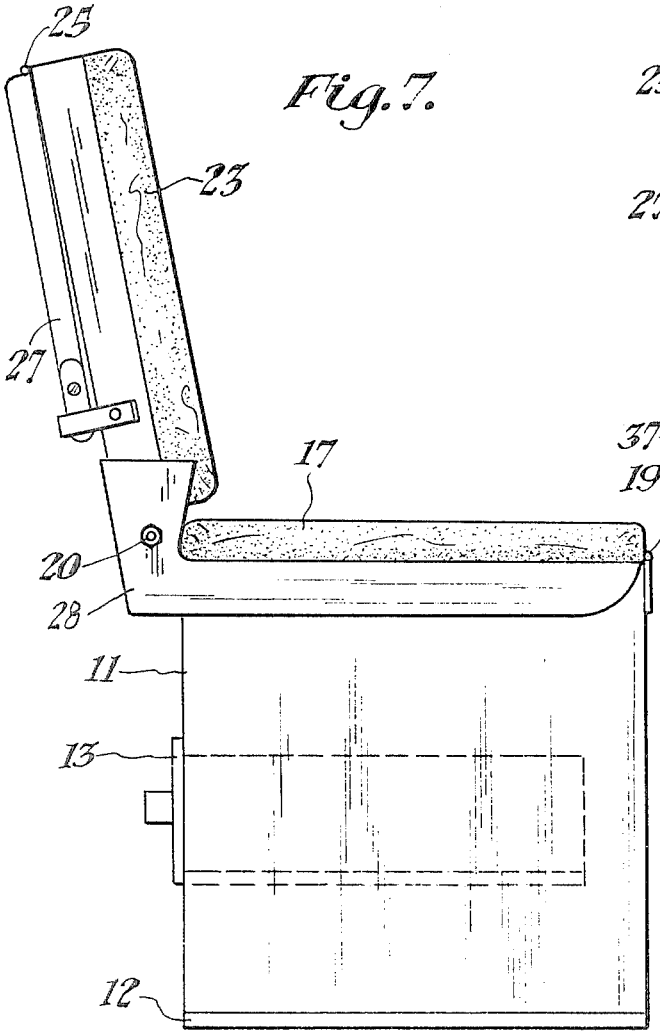
Fig. 3.
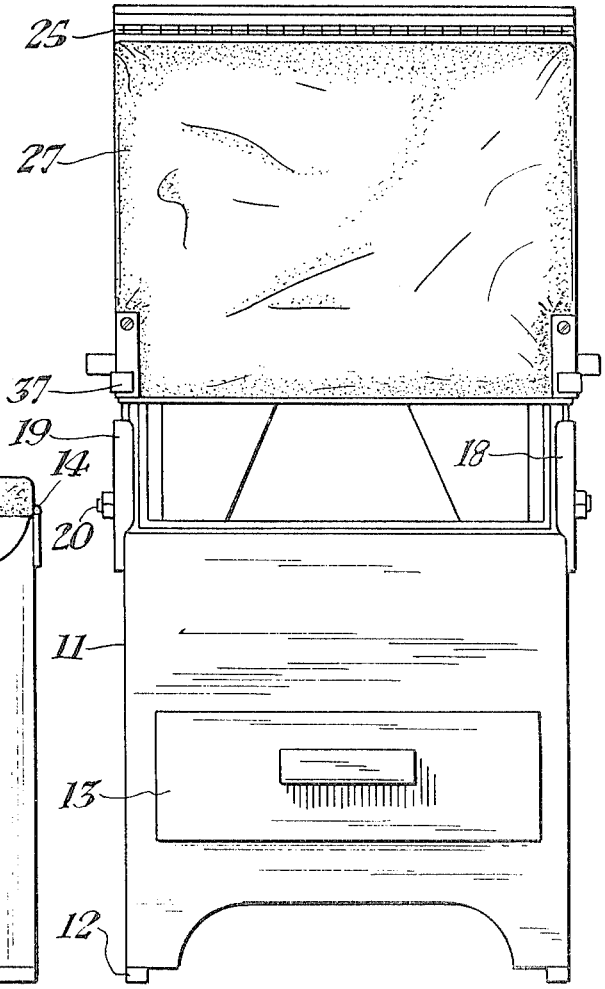

CONVERTIBLE SEAT ASSEMBLY

BACKGROUND OF THE INVENTION

1. Field of the Invention

This invention relates to a seat assembly for pleasure boats and the like having a storage drawer therein which is convertible between a single seat and back-to-back seats.

2. Prior Art Relating to the Disclosure

Seat assemblies for pleasure boats which are convertible to a back-to-back chair, bed, and/or couch are known (see U.S. Pat. No. 3,884,522 Arima et al and U.S. Pat. No. 2,383,178 to Edwards. The seats disclosed in the prior art occupy the floor space of the back-to-back seats or the bed even while the assembly is positioned to use only one seat. Prior art devices do not contain drawer storage compartments and cannot be folded to fit into as small an area as can the present chair assembly.

SUMMARY OF THE INVENTION

The chair assembly has as a base a cube-shaped member to which all the other components are either directly or indirectly connected. Within the base are one or more storage compartments in the form of cabinets and/or drawers with opening access to said compartments along the back face of said cube base and the top of the base. The base and compartment are composed of wood or other similar suitable rigid material. The top edge of the base is surrounded by a band of metal for added structural support. Connected to the surrounding band and covering the top surface of the base is a plate-like board and a cushion. Welded to and extending upward from each of the rear corners of the metal band are metal brace members. A metal rod extends through and connects the metal braces. The seat back is composed of a heavy metal frame covered by a wooden plate and a cushion. The frame is supported within the braces and is connected to them via the rod passing through the frame and braces the braces have front and back lips which limit the arcuate travel of the seat back frame. A second metal frame which forms the seat bottom of the second seat is connected via the same rod in a manner which allows the frame to be moved in a hinge-like fashion from a vertical position against the seat back to a horizontal position extending outward from the seat back. The second metal frame has a plate-like board and cushion connected thereto to form the seat bottom of the second seat. A support means for the second seat is connected via a hinge to the second frame member. A third metal frame which forms the seat back of the second seat is hinged to the metal frame of the first seat back. The third metal frame has a plate-like board and cushion connected thereto.

When the seat assembly is in a one seat position, the metal frame of the first seat back is held vertically within the braces. The seat bottom of the second seat is held vertically and flush against the back of the first seat back and the support member of the second seat bottom is held vertically and flush against the seat bottom of the second seat. The seat back of the second seat lies vertically against the support member and thus covers the second seat bottom and support member which have been folded against the back of the first seat back. In this position the seat assembly requires only the small amount of floor space under the base of the first seat.

When the seat assembly is in the back-to-back seat position, the seat portion of the second seat extends horizontally from the base and is supported on its outer front edge by the vertical downwardly extending support member. The third metal frame forming the seat back of the second seat lies against the back of the frame of the first seat back.

In accordance with the above described structure and operation, it is the primary object of this invention to provide a seat assembly which may act as two seats or be folded into one seat.

Another object is to provide such a seat assembly which occupies the floor space of only one seat while the assembly is folded into the one seat position.

Still another object is to provide such a seat assembly which has storage compartment space in the base.

Yet another object is to provide such a seat assembly which can be quickly and easily converted from a single seat into back-to-back seats.

Still yet another object is to provide such a seat assembly which can be easily and inexpensively manufactured.

Another object is to provide such a seat assembly which is extremely stable and structurally strong.

In accordance with these and other objects which will be apparent hereinafter, the instant invention will now be described with particular reference to the accompanying drawings.

BRIEF DESCRIPTION OF THE DRAWINGS

FIG. 1 is a plain side view of the seat assembly in the back-to-back seat position.

FIG. 2 is a plain side view of the seat assembly in the single seat position with the side panel of the base removed.

FIG. 3 is a plain back view of the seat assembly in the single seat position.

FIG. 4 is a plain side view of the seat assembly being unfolded.

FIG. 5 is a side view of the seat assembly with the seat bottom being raised.

FIG. 6 is a top plan view of the seat with the back portion in a vertical position.

FIG. 7 is a side view of the seat.

DETAILED DESCRIPTION OF THE INVENTION

Referring now to drawings and to FIG. 1 in particular. The chair assembly referred to generally by the number 10 is shown from the side in the back-to-back seat position. The base 11 is cube-shaped having a bottom 12 and a drawer 13 which opens on the back face of the cube. A hinge member 14 connects the front face of base 11 to a metal frame member 15. The frame 15 is secured to the seat bottom plate 16 which is in turn covered by cushion 17. Upright brace members 18 and 19 (seen in FIG. 3) are securely connected to the rear corners of frame 15. A rod 20 interconnects braces 18 and 19. The rod 20 passes through the frame 21 and supports frame 21 within the braces 18 and 19. The frame 21 is securely attached to seat back plate 22 which is covered by seat back cushion 23. A seat back 24 is secured along a hinge 25 to the upper back edge of frame 21. Frame 24 is covered by cushion 27. The rod 20 passes through metal frame 28 and securely holds it between braces 18 and 19. Seat bottom plate 29 is connected to frame 28 and plate 29 is covered by cushion 30. A seat support member 31 is connected to the front edge of frame 28 by a hinge 32. Support 31 is further secured to frame 28 via folding hinge member 33.

Referring now to FIG. 2 where the seat assembly 10 is shown from the side. The side panel of base 11 has been removed so that the drawer 13 may be seen. The board 34 which forms the bottom of storage compartment 35 may also be seen. Access to compartment 35 is achieved by raising the frame 15 and its connected seat bottom as shown in FIG. 5. In order to achieve the folded-up one seat position of the seat 10 as shown in FIG. 2, the seat back 27 must be lifted as shown in FIG. 4. The support 31 is then folded up against the bottom of frame 28 and the support 31 and frame 28 are swung upwardly (as shown in FIG. 4) until the top of cushion 30 is against the back of seat back frame 21. The cushion 27 is then lowered into position as in FIG. 2 and clip locks 36 and 37 (as shown in FIG. 3) are swiveled into position to hold the cushion 27 in place against the frame 21 as shown in FIG. 1. The seat bottom 29 and cushion 30 as well as support member 31 are held behind cushion 27 and within frame 21 as shown in FIG. 2.

It should be noted that the present invention is ideally suited for use in small fishing boats. The seat may be used by the driver alone, by a fisherman facing toward the boat's stern, and/or the driver and fisherman simultaneously. The storage compartments are useful for storing fishing equipment such as hooks, weights, lures, and the like. The seat is stable and occupies only a small amount of space within the boat.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A seat assembly which is convertible from a single seat into back-to-back seats, comprising:

a main seat base member, said main seat base member having a front surface, a back surface, a first side and a second side, a first seat bottom connected to said base member by a hinge means, a first seat bottom frame member connected to said first seat bottom a first brace member connected to said first seat bottom adjacent said seat base member first side, a second base member connected to said first seat bottom adjacent said seat base member second side, a seat back metal frame member pivotally mounted to said first and second brace members, each said first and second brace member having a front and back lip means for limiting arcuate travel of said seat back frame member, a first seat back connected to said seat back frame member, a second seat back connected by a hinge means to said seat back frame, said second seat back facing the opposite direction from said first seat back, and a second seat bottom frame member pivotally mounted to said first and second braces, a second seat bottom connected to said second seat bottom frame member, and a seat support member pivotally mounted to said second seat bottom.

2. A seat assembly as in claim 1, further comprising:

a cushion connected to said first seat bottom, and a cushion connected to said first seat back, and a cushion connected to said second seat bottom, and a cushion connected to said second seat back.

3. A seat assembly as in claim 2, further comprising:

a drawer held within said base member, and a storage compartment held within said base member.

4. A seat assembly as in claim 1, wherein:

said seat support member folds into said second seat bottom frame member, said second seat bottom folds into the back of said seat back frame member, said second seat back folds over said second seat bottom, said second seat back retaining said second seat bottom in said seat back frame member.

5. A seat assembly as in claim 2, wherein:

said first seat bottom, hinged to said seat base member folds open exposing said storage compartment held within said base member.

* * * * *